US012359365B2

(12) United States Patent
Reeves et al.

(10) Patent No.: US 12,359,365 B2
(45) Date of Patent: Jul. 15, 2025

(54) DRYER APPLIANCE DRY TIME ESTIMATION

(71) Applicant: Haier US Appliance Solutions, Inc., Wilmington, DE (US)

(72) Inventors: Joshua Reeves, Louisville, KY (US); Dale Pleasant Pepoon, Taylorsville, KY (US); Ryan James Scheckelhoff, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 837 days.

(21) Appl. No.: 17/543,805

(22) Filed: Dec. 7, 2021

(65) Prior Publication Data

US 2023/0175193 A1 Jun. 8, 2023

(51) Int. Cl.

| | |
|---|---|
| ***D06F 58/38*** | (2020.01) |
| ***D06F 34/18*** | (2020.01) |
| ***D06F 58/48*** | (2020.01) |
| *D06F 103/04* | (2020.01) |
| *D06F 103/44* | (2020.01) |

(52) U.S. Cl.

CPC ..... *D06F 58/38* (2020.02); *D06F 34/18* (2020.02); *D06F 58/48* (2020.02); *D06F 2103/04* (2020.02); *D06F 2103/44* (2020.02)

(58) Field of Classification Search

None

See application file for complete search history.

(56) References Cited

U.S. PATENT DOCUMENTS

| | | | | |
|---|---|---|---|---|
| 5,193,292 | A * | 3/1993 | Hart | D06F 58/48 34/527 |
| 8,375,599 | B2 | 2/2013 | Dey | |
| 9,159,217 | B1 | 10/2015 | Logan | |
| 9,386,140 | B2 | 7/2016 | Logan | |
| 9,888,452 | B2 | 2/2018 | Logan | |
| 10,087,565 | B2 | 10/2018 | Janke | |
| 10,793,996 | B2 | 10/2020 | Seo | |
| 2011/0153104 | A1 | 6/2011 | Drake | |

FOREIGN PATENT DOCUMENTS

| | | | | |
|---|---|---|---|---|
| EP | 2221412 | B1 | 1/2012 | |
| EP | 2927367 | A1 * | 10/2015 | D06F 58/28 |
| EP | 2281935 | B1 | 4/2016 | |
| KR | 101276857 | B1 | 6/2013 | |
| TR | 201716220 | A2 * | 11/2017 | |

* cited by examiner

*Primary Examiner* — Jason Lau

(74) *Attorney, Agent, or Firm* — Dority & Manning, P.A.

(57) ABSTRACT

A method of operating a dryer appliance includes determining a remaining moisture content of a load of articles to be dried in the dryer appliance and estimating an energy requirement for drying the load of articles based on the determined remaining moisture content of the load of articles. The method also includes activating a heating system of the dryer appliance during a dry cycle of the dryer appliance while tracking an energy output of the heating system during the dry cycle. The method further includes comparing the tracked energy output to the estimated energy requirement. When the tracked energy output is greater than a predetermined threshold percentage of the estimated energy requirement, a user notification is provided.

14 Claims, 6 Drawing Sheets

DRYER APPLIANCE DRY TIME ESTIMATION

FIELD OF THE INVENTION

The present subject matter relates generally to dryer appliances, and more particularly to dryer appliances configured for estimating remaining dry time, and related methods.

BACKGROUND OF THE INVENTION

A conventional appliance for drying articles such as a clothes dryer (or laundry dryer) for drying clothing articles typically includes a cabinet having a rotating drum for tumbling clothes and laundry articles therein. One or more heating elements, for example electric heating elements, heat air prior to the air entering the drum, and the warm air is circulated through the drum as the clothes are tumbled to remove moisture from laundry articles in the drum.

Typically, dryer appliances provide an estimated cycle time for a given cycle based on option settings and/or previous dry times for similar options. However, such estimated cycle times are not always accurate across multiple machines with varying tolerances and installation conditions.

Accordingly, a dryer appliance having improved features for and improved methods of estimating the remaining time in a dry cycle would be advantageous.

BRIEF DESCRIPTION OF THE INVENTION

Aspects and advantages of the invention will be set forth in part in the following description, or may be obvious from the description, or may be learned through practice of the invention.

In an exemplary aspect of the present disclosure, a method of operating a dryer appliance is provided. The dryer appliance includes a cabinet with a drum rotatably mounted within the cabinet. The drum defines a chamber for the receipt of articles for drying. The dryer appliance also includes a heating system fluidly coupled to the drum whereby heated air flows from the heating system to the chamber of the drum for drying of articles within the chamber. The method includes determining a remaining moisture content of a load of articles to be dried in the dryer appliance and estimating an energy requirement for drying the load of articles based on the determined remaining moisture content of the load of articles. The method also includes activating the heating system of the dryer appliance during a dry cycle of the dryer appliance and tracking an energy output of the heating system during the dry cycle. The method further includes comparing the tracked energy output to the estimated energy requirement and providing a user notification when the tracked energy output is greater than a predetermined threshold percentage of the estimated energy requirement.

In yet another exemplary aspect of the present disclosure, a dryer appliance is provided. The dryer appliance includes a cabinet with a drum rotatably mounted within the cabinet. The drum defines a chamber for the receipt of articles for drying. The dryer appliance also includes a heating system fluidly coupled to the drum whereby heated air flows from the heating system to the chamber of the drum for drying of articles within the chamber. The dryer appliance further includes a controller. The controller is configured for determining a remaining moisture content of a load of articles to be dried in the dryer appliance and estimating an energy requirement for drying the load of articles based on the determined remaining moisture content of the load of articles. The controller is also configured for activating the heating system of the dryer appliance during a dry cycle of the dryer appliance and tracking an energy output of the heating system during the dry cycle. The controller is further configured for comparing the tracked energy output to the estimated energy requirement and providing a user notification when the tracked energy output is greater than a predetermined threshold percentage of the estimated energy requirement.

These and other features, aspects, and advantages of the present disclosure will become better understood with reference to the following description and appended claims. The accompanying drawings, which are incorporated in and constitute a part of this specification, illustrate embodiments of the disclosure and, together with the description, serve to explain the principles of the disclosure.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
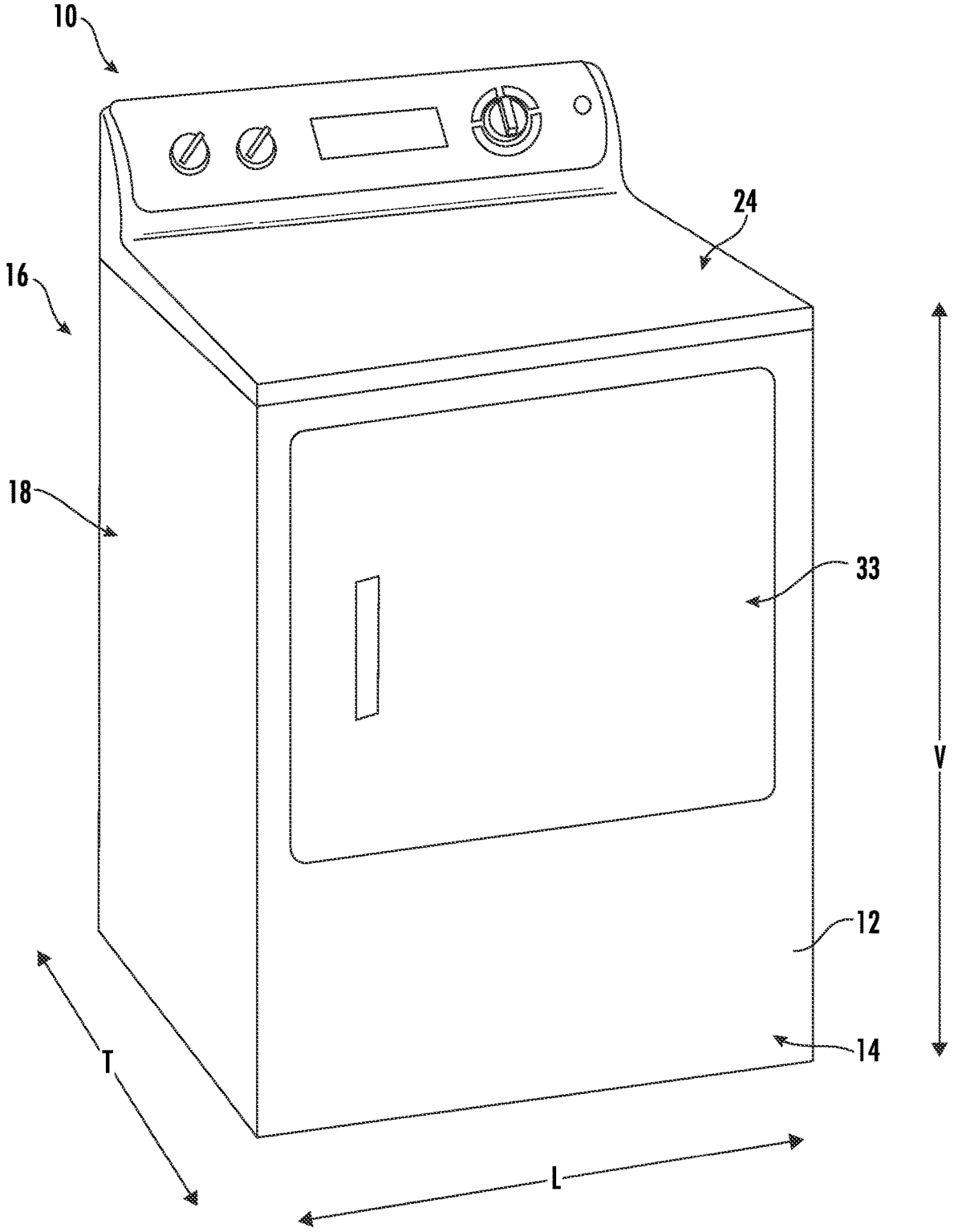
FIG. 1 provides a perspective view of a dryer appliance in accordance with exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Figure 2:
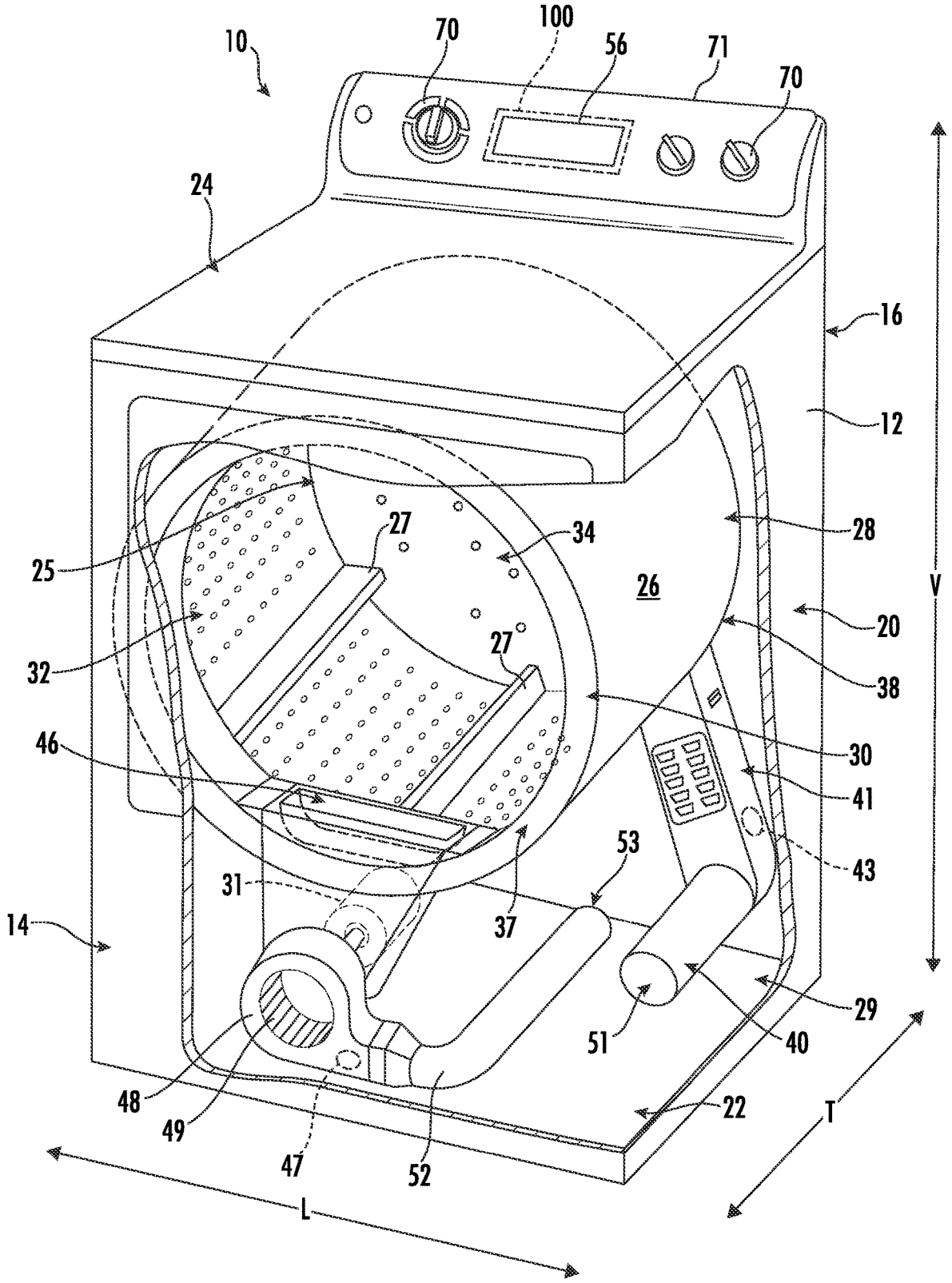
FIG. 2 provides a perspective view of the example dryer appliance of FIG. 1 with portions of a cabinet of the dryer appliance removed to reveal certain components of the dryer appliance.

Turning now to the figures, FIG. 1 provides a perspective view of dryer appliance 10 according to one or more exemplary embodiments of the present disclosure. FIG. 2 provides another perspective view of dryer appliance 10 with a portion of a cabinet or housing 12 of dryer appliance 10 removed in order to show certain components of dryer appliance 10. Dryer appliance 10 generally defines a vertical direction V, a lateral direction L, and a transverse direction T, each of which is mutually perpendicular, such that an orthogonal coordinate system is defined. While described in the context of a specific embodiment of dryer appliance 10, using the teachings disclosed herein, it will be understood that dryer appliance 10 is provided by way of example only. Other dryer appliances having different appearances and different features may also be utilized with the present subject matter as well.

Cabinet 12 includes a front panel 14, a rear panel 16, a pair of side panels 18 and 20 spaced apart from each other by front and rear panels 14 and 16, a bottom panel 22, and a top cover 24. Within cabinet 12, an interior volume 29 is defined. A drum or container 26 is mounted for rotation about a substantially horizontal axis within the interior volume 29. Drum 26 defines a chamber 25 for receipt of articles of clothing for tumbling and/or drying. Drum 26 extends between a front portion 37 and a back portion 38. Drum 26 also includes a back or rear wall 34, e.g., at back portion 38 of drum 26. A supply duct 41 may be mounted to rear wall 34 and receives heated air that has been heated by a heating assembly or system 40.

As used herein, the terms "clothing" or "articles" includes but need not be limited to fabrics, textiles, garments, linens, papers, or other items from which the extraction of moisture is desirable. Furthermore, the term "load" or "laundry load" refers to the combination of clothing that may be washed together in a washing machine or dried together in a dryer appliance 10 (e.g., clothes dryer) and may include a mixture of different or similar articles of clothing of different or similar types and kinds of fabrics, textiles, garments and linens within a particular laundering process.

A motor 31 is provided in some embodiments to rotate drum 26 about the horizontal axis, e.g., via a pulley and a belt (not pictured). Drum 26 is generally cylindrical in shape, having an outer cylindrical wall 28 and a front flange or wall 30 that defines an opening 32 of drum 26, e.g., at front portion 37 of drum 26, for loading and unloading of articles into and out of chamber 25 of drum 26. A plurality of lifters or baffles 27 are provided within chamber 25 of drum 26 to lift articles therein and then allow such articles to tumble back to a bottom of drum 26 as drum 26 rotates. Baffles 27 may be mounted to drum 26 such that baffles 27 rotate with drum 26 during operation of dryer appliance 10.

Drum 26 includes a rear wall 34 rotatably supported within main housing 12 by a suitable fixed bearing. Rear wall 34 can be fixed or can be rotatable. Rear wall 34 may include, for instance, a plurality of holes that receive hot air that has been heated by a heating assembly or system 40, as will be described further below. Motor 31 is also in mechanical communication with an air handler 48 such that motor 31 rotates a fan 49, e.g., a centrifugal fan, of air handler 48. Air handler 48 is configured for drawing air through chamber 25 of drum 26, e.g., in order to dry articles located therein. In alternative example embodiments, dryer appliance 10 may include an additional motor (not shown) for rotating fan 49 of air handler 48 independently of drum 26.

Drum 26 is configured to receive heated air that has been heated by a heating assembly 40, e.g., via holes in the rear wall 34 as mentioned above, in order to dry damp articles disposed within chamber 25 of drum 26. For example, heating assembly 40 may include a heating element (not shown), such as a gas burner, an electrical resistance heating element, or heat pump, for heating air. In particular embodiments, the heating assembly 40 may be or include an electric heater comprising a plurality of electric resistance heating elements with a plurality of relays for selectively providing or obstructing electrical power to the heating elements, such as two relays which permit operation of the heating assembly 40 at various power levels, such as 50% power when only one of two relays is closed. As discussed above, during operation of dryer appliance 10, motor 31 rotates drum 26 and fan 49 of air handler 48 such that air handler 48 draws air through chamber 25 of drum 26 when motor 31 rotates fan 49. In particular, ambient air enters heating assembly 40 via an inlet 51 due to air handler 48 urging such ambient air into inlet 51. Such ambient air is heated within heating assembly 40 and exits heating assembly 40 as heated air. Air handler 48 draws such heated air through supply duct 41 to drum 26. The heated air enters drum 26 through a plurality of outlets of supply duct 41 positioned at rear wall 34 of drum 26.

Within chamber 25, the heated air may accumulate moisture, e.g., from damp clothing disposed within chamber 25. In turn, air handler 48 draws moisture-saturated air through a screen filter (not shown) which traps lint particles. Such moisture-statured air then enters an exit duct 46 and is passed through air handler 48 to an exhaust duct 52. From exhaust duct 52, such moisture-statured air passes out of dryer appliance 10 through a vent 53 defined by cabinet 12. After the clothing articles have been dried, they are removed from the drum 26 via opening 32. A door 33 (FIG. 1) provides for closing or accessing drum 26 through opening 32. The door 33 may be movable between an open position and a closed position, the open position for access to the chamber 25 defined in the drum 26, and the closed position for sealingly enclosing the chamber 25 defined in the drum 26.

In some embodiments, one or more selector inputs 70, such as knobs, buttons, touchscreen interfaces, etc., may be provided or mounted on a cabinet 12 (e.g., on a backsplash 71 of the cabinet 12) and are in operable communication (e.g., electrically coupled or coupled through a wireless network band) with a processing device or controller 100. A display 56 may also be provided on the backsplash 71 and may also be in operable communication with the controller 100. Controller 100 may also be provided in operable communication with motor 31, air handler 48, and/or heating assembly 40. In turn, signals generated in controller 100 direct operation of motor 31, air handler 48, and/or heating assembly 40 in response to the position of inputs 70. In the example illustrated in FIG. 2, the inputs 70 are provided as knobs. In other embodiments, inputs 70 may also or instead include buttons, switches, touchpads and/or a touch screen type interface.

Controller 100 is a "processing device" or "controller" and may be embodied as described herein. As used herein, "processing device" or "controller" may refer to one or more microprocessors, microcontrollers, application-specific integrated circuits (ASICS), or semiconductor devices and is not restricted necessarily to a single element. The controller 100 may be programmed to operate dryer appliance 10 by executing instructions stored in memory (e.g., non-transitory media). The controller 100 may include, or be associated with, one or more memory elements such as RAM, ROM, or electrically erasable, programmable read only memory (EEPROM). For example, the instructions may be software or any set of instructions that when executed by the processing device, cause the processing device to perform operations. Controller 100 may include one or more processor(s) and associated memory device(s) configured to perform a variety of computer-implemented functions and/or instructions (e.g. performing the methods, steps, calculations and the like and storing relevant data as disclosed herein). It should be noted that controllers as disclosed herein are capable of and may be operable to perform any methods and associated method steps as disclosed herein. For example, in some embodiments, methods disclosed herein may be embodied in programming instructions stored in the memory and executed by the controller.

In some exemplary embodiments, the dryer appliance 10 may include one or more temperature sensors, such as inlet temperature sensor 43 and/or outlet temperature sensor 47. The temperature sensor(s) may be in operative communication with the controller 100. For example, in various embodiments, the controller 100 may be operable to detect, measure, and/or monitor one or more temperatures within the dryer appliance 10. Such temperatures which may be detected, measured, and/or monitored include, for example, an inlet temperature measured with the inlet temperature sensor 43 and/or an outlet temperature measured with the outlet temperature sensor 47. The temperature sensors 43 and 47 may be, in some embodiments, thermistors.

Figure 3:
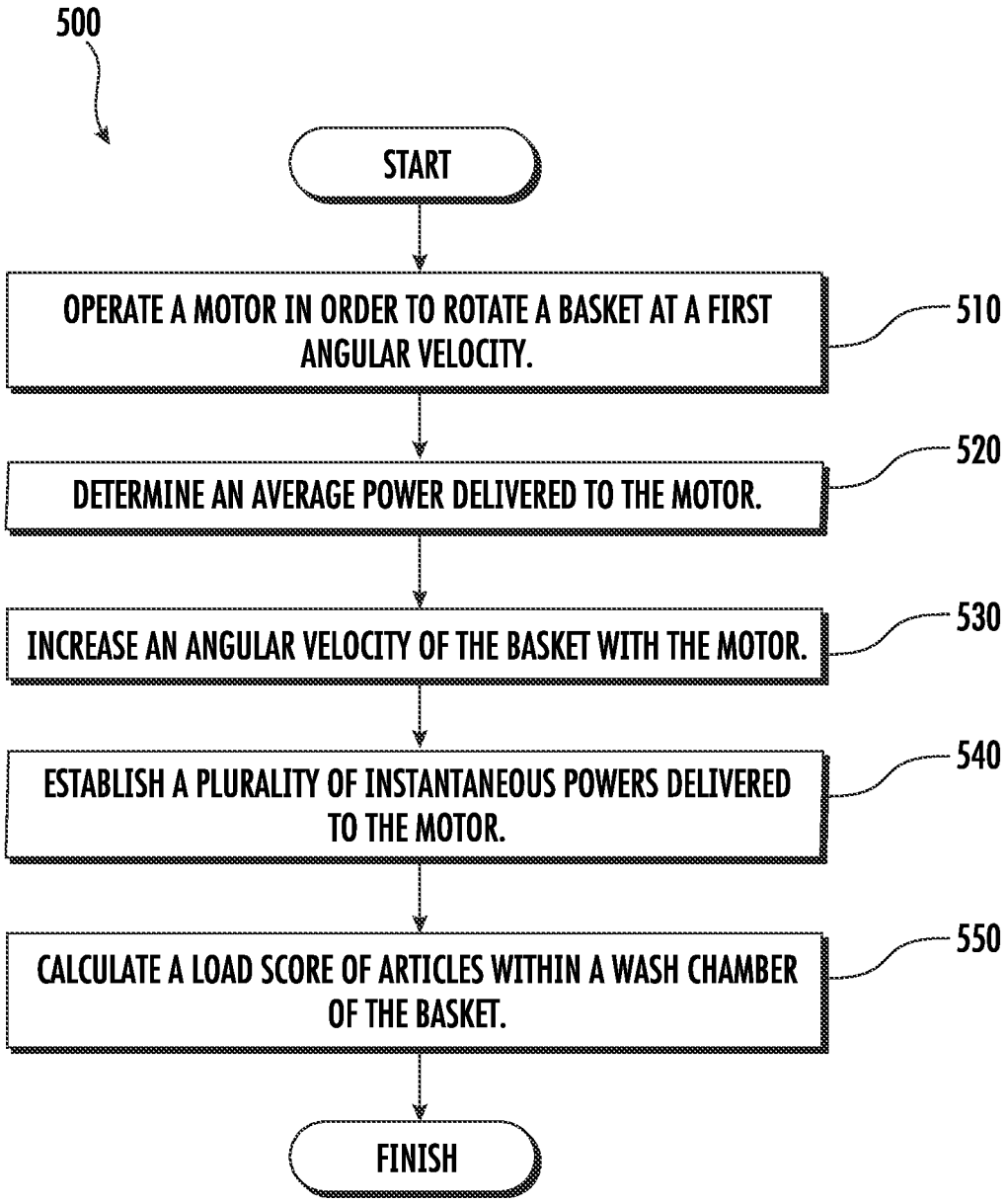
FIG. 3 provides a flow chart of an exemplary method for calculating a load score for a load in a washing machine appliance according to an exemplary embodiment of the present subject matter.

FIG. 3 illustrates a method 500 for operating a washing machine appliance according to an exemplary embodiment of the present subject matter. The washing machine appliance may be any suitable washing machine appliance. Such washing machine appliances, including the structure, e.g., basket and wash chamber, etc., and function thereof, are well understood by those of ordinary skill in the art. As such, the washing machine appliance itself is not specifically illustrated or described in further detail herein for the sake of brevity and clarity.

Figure 4:
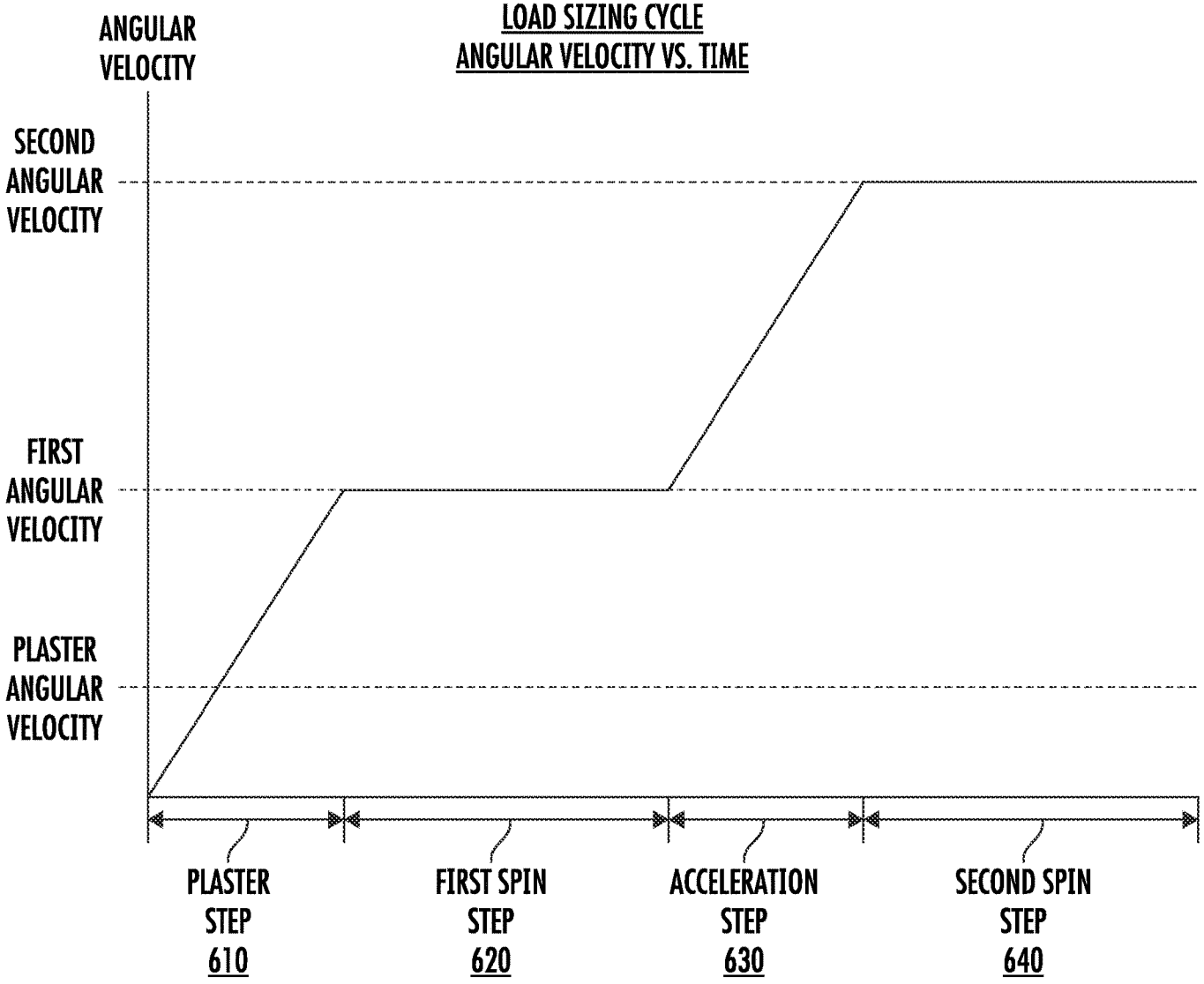
FIG. 4 provides a plot of an angular velocity of a basket over time during a load sizing cycle of a washing machine appliance.

Utilizing method 500, a load size of articles within a wash chamber of a basket in the washing machine appliance can be estimated or measured. In particular, a mass of articles within the wash chamber can be estimated or measured utilizing method 500. FIG. 4 provides a plot of an angular velocity of the basket over time during a load sizing cycle of the washing machine appliance. Method 500 can be performed during the load sizing cycle of a washing machine appliance shown in FIG. 4. Method 500 is discussed in greater detail below in the context of the load sizing cycle illustrated in FIG. 4.

As may be seen in FIG. 4, the load sizing cycle includes a plaster step 610. During plaster step 610, a controller may operate a motor of the washing machine appliance. In particular, the motor can accelerate the basket such that an angular velocity of the basket increases, e.g., to about a first angular velocity, during the plaster step 610. The first angular velocity can be any suitable angular velocity. For example, the first angular velocity may be greater than a plaster angular velocity of articles within the wash chamber of the basket. Thus, when the motor rotates the basket at the first angular velocity, articles within the wash chamber of the basket can be plastered against and/or stick to the basket because the angular velocity of the basket exceeds the plaster angular velocity of the basket. With articles within the wash chamber of the basket plastered against the basket, articles within the wash chamber can be substantially stationary or fixed relative to the basket during rotation of the basket.

At step 510 (FIG. 3), the controller operates the motor in order to rotate the basket at the first angular velocity. At step 520, the controller determines an average power delivered to the motor, e.g., during step 510. For example, as shown in FIG. 4, the motor rotates the basket at the first angular velocity during a first spin step 620 of the load sizing cycle. At step 520, the controller can determine the average power delivered to the motor during the entirety of the first spin step 620 or during a portion of the first spin step 620. As will be understood by those skilled in the art, a power delivered to the motor when the basket is rotating at a constant angular velocity can correspond to about a power required to overcome friction and other static factors hindering rotation of the basket, e.g., because the basket is not accelerating. Thus, the average power delivered to the motor determined at step 520 can be used to estimate or gauge the friction and other steady state losses within the motor and other components of the washing machine appliance that impede rotation of the basket.

At step 530, the angular velocity of the basket is increased. As an example, the controller can operate the motor in order to increase the angular velocity of the basket, e.g., after step 510. In particular, the controller can increase the angular velocity of the basket from about the first angular velocity to about a second angular velocity with the motor at step 530. The second angular velocity can be any suitable angular velocity. For example, the second angular velocity may be greater than the first angular velocity.

At step 540, the controller establishes a plurality of instantaneous powers delivered to the motor, e.g., during step 530. As an example, an instantaneous power may be measured about every ten milliseconds during step 530 in order to establish the plurality of instantaneous powers delivered to the motor at step 540. As may be seen in FIG. 4, the motor increases the angular velocity of the basket from about the first angular velocity to about the second angular velocity during an acceleration step 630 of the load sizing cycle. At step 540, the controller can determine the plurality of instantaneous powers delivered to the motor during the entirety of the acceleration step 630 or during a portion of the acceleration step 630. As will be under stood by those skilled in the art, the power delivered to the motor when the basket is accelerating can correspond to about a power required to overcome friction and other static factors hindering rotation of the basket as well as the power required to accelerate the basket. Thus, each instantaneous power delivered to the motor during step 530 can be used to estimate or gauge the power required to accelerate the basket after accounting for the friction and other steady state losses within the motor and other components of the washing machine appliance that impede rotation of the basket.

At step 550, the controller calculates a load score of articles within the wash chamber of the basket based at least in part on the average power delivered to the motor during step 520 and the plurality of instantaneous powers delivered to the motor during step 530. The load score is, e.g., directly, proportional to a load size of articles within the wash chamber of the basket. As an example, the load score of articles within the wash chamber of the basket may be calculated with the following at step 550, $$\text{Load Score} = \sum_{t_0}^{t_1}\left(P(t) - P_{avg,ss} * \frac{n(t)}{n_{avg,ss}}\right)$$

where

P is an instantaneous power delivered to the motor at time t during step 530, $P_{avg,ss}$ is the average power delivered to the motor during step 510, n is an angular velocity of the basket at time t during step 530, and $n_{avg,ss}$ is the first angular velocity.

Thus, the load score of articles within the wash chamber of the basket can correspond to a sum of the difference between each instantaneous power delivered to the motor at step 540 and a product of the average power delivered to the motor during step 510 and a weighting or scaling factor, where the weighting factor is a quotient of the angular velocity of the basket at time t and the first angular velocity.

The load score of articles within the wash chamber of the basket can be directly proportional to a mass, m, of articles within the wash chamber of the basket such that $$m \propto \text{Load Score}$$

Thus, method 500 can also include correlating the load score of articles within the wash chamber of the basket to the mass of articles within the wash chamber of the basket. For example, the controller can obtain an associated mass of the load score from a lookup table or a function, such as a transfer function, within the memory of the controller.

It should be understood that method 500 can also include repeating steps 510, 520, 530, 540 and 550 and calculating an average load score for articles within the wash chamber of the basket. Repeating steps 510-550 can improve the accuracy and/or consistency of method 300. However, repeating steps 510, 520, 530, 540 and 550 can increase a duration or time interval of method 500.

Moreover, those of ordinary skill in the art will recognize that the load sizing cycle and/or method 500 of FIGS. 3 and 4 maybe performed with a standard washing machine appliance, e.g., using the controller, motor, and basket of the standard washing machine appliance. Accordingly, because the structure of such washing machine appliances, including the wash chamber, basket, motor, and controller thereof, are well understood by those of ordinary skill in the art, the washing machine appliance is not specifically illustrated or described in further detail herein for the sake of brevity and clarity.

Figure 5:
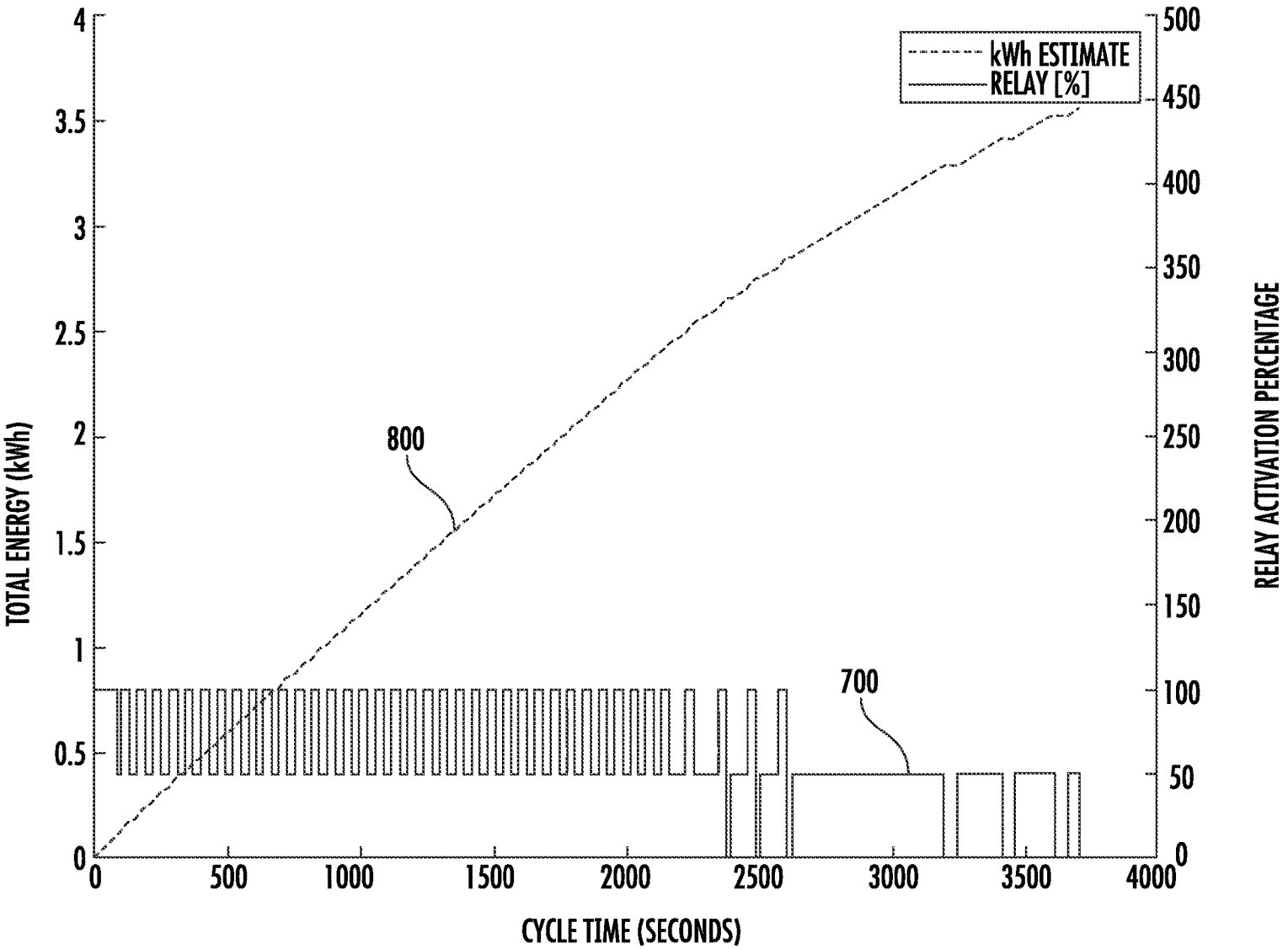
FIG. 5 provides a graph of energy output over time during an exemplary dry cycle of a dryer appliance.

FIG. 5 provides a graph of cumulative total energy supplied to a load of articles in a dryer appliance, such as the exemplary dryer appliance 10 of FIGS. 1 and 2. The example dryer appliance of which a dry cycle is illustrated in FIG. 5 includes two heating elements in the heating system, and the operation of the heating elements is simplified to either fully on or off, e.g., when neither heating element is activated the relay activation percentage is zero, when one heating element is activated the relay activation percentage is fifty, and when both heating elements are activated the relay activation percentage is one hundred. In particular, one of two heating elements being activated at full power equals fifty percent, and both heating elements being activated each at full power equals one hundred percent for the heating system as a whole. In other embodiments, the heating system may be operable over a wider range of percentages, such as (up to and including) infinitely variable between zero percent and one hundred percent. For example, the heating system may include any number of heating elements, and the heating elements may be operable over a more variable range, such as with a solid state relay, whereby the heating elements may be operable at any level (percentage) between and including zero percent and one hundred percent. Thus, the exemplary line 700 in FIG. 5 which represents power level, e.g., relay activation percentage, increments in steps between zero, fifty, and one hundred percent, but such discrete increments are by way of example only and for purposes of simplicity. Further, line 700 tracks the on time (greater than zero percent) and off time (zero percent), e.g., the duty cycle, of the heating system throughout the dry cycle, e.g., along the X (horizontal) axis in FIG. 5. FIG. 5 also includes a line 800 which represents the cumulative total energy supplied to the load of articles in the dryer over the course of the cycle, e.g., in kilowatt-hours (kWh).

Figure 6:
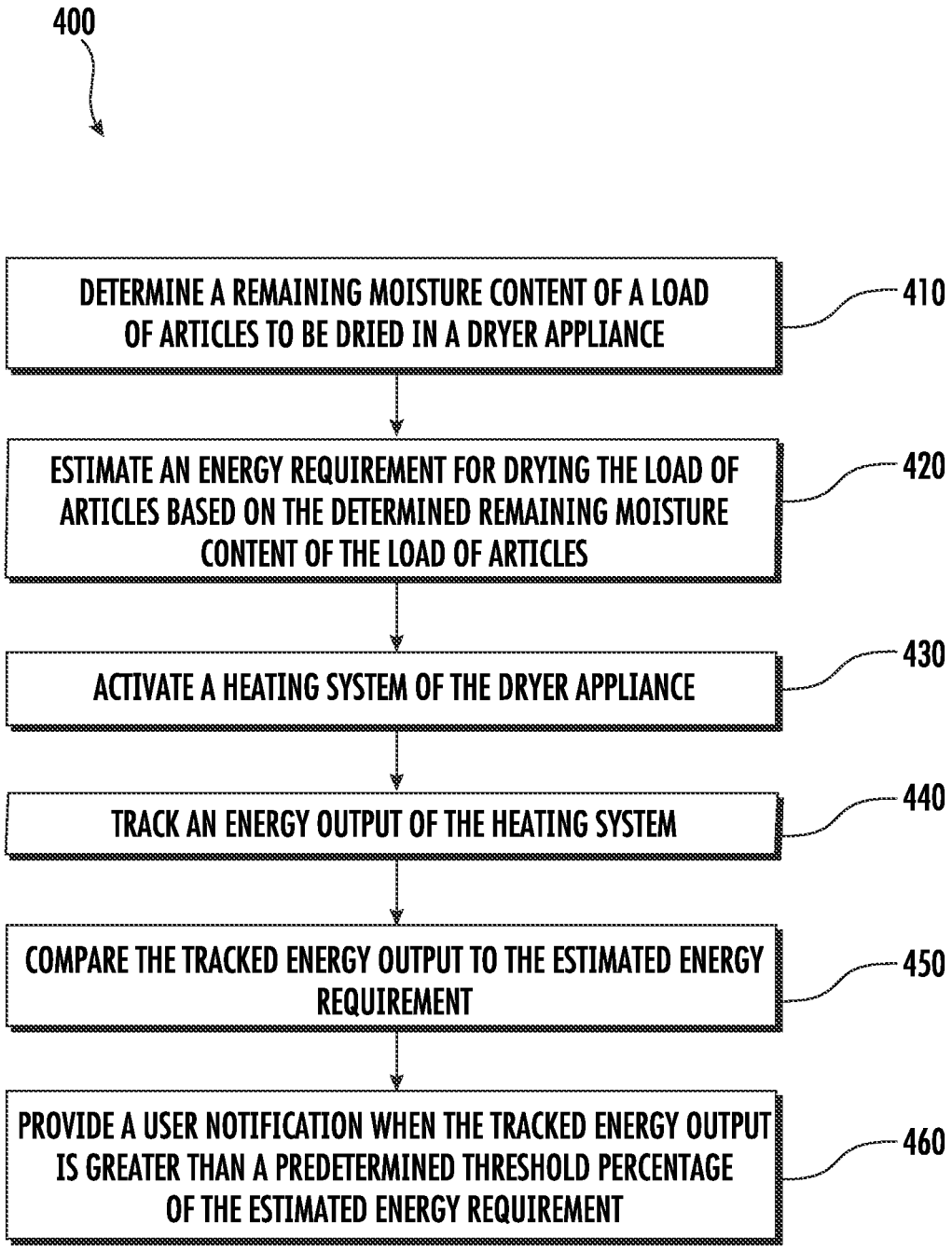
FIG. 6 provides a flow chart of an exemplary method of operating a dryer appliance.

Turning now to FIG. 6, exemplary embodiments of the present disclosure also include methods of operating a dryer appliance, where the dryer appliance may be, but is not limited to, the exemplary dryer appliance 10 of FIGS. 1 and 2. In particular, FIG. 6 illustrates a flow chart of an exemplary method 400 of operating a dryer appliance.

As shown in FIG. 6, the exemplary method 400 may include a step 410 of determining a remaining moisture content of a load of articles to be dried in the dryer appliance. The remaining moisture content may be determined based on one or more load scores of the load of articles, e.g., which may be determined as described above with reference to FIGS. 3 and 4. For example, method 400 may include determining a plurality of load scores, e.g., receiving load scores from a connected washing machine appliance. The plurality of load scores may include a dry load score, a wet or saturated load score, and a damp load score, or any combination of two or more of the foregoing load scores.

The dry load score may be proportional to the mass of the articles themselves, e.g., without any water or wash liquid. For example, the dry load score may be determined prior to an initial fill of a wash cycle whereby the articles, having been loaded into the washing machine appliance for the wash cycle, are generally dry or relatively dry as compared to later stages of the same wash cycle.

The wet load score may be proportional to the mass of the articles plus a full volume of water, such as a rinse volume of the wash cycle. Thus, the wet load score may be obtained after the initial fill of the wash cycle and before a spin cycle or extraction phase of the spin cycle of the wash cycle, such as after a rinse phase of the wash cycle.

The damp load score may be proportional to the mass of the articles plus a portion of the volume of water, such as the portion of the volume of water remaining after the extraction phase or spin cycle. For example, the damp load score may be obtained (calculated) after the spin cycle, including the extraction phase, is completed. In particular, the damp load score may be a post-extraction load score calculated after a max extraction phase of a spin cycle of the wash operation or wash cycle is complete.

The remaining moisture content may be determined based on a difference between two of the load scores, such as the damp (post-extraction) load score minus the dry load score. Thus, in some embodiments, step 410 of determining the remaining moisture content in the method 400 may also include receiving remaining moisture content information from a washer appliance, such as receiving the load scores from the connected washer appliance and calculating the difference by the controller of the dryer appliance or receiving the difference between the load scores from the washing machine appliance when the difference is calculated by a controller of the washing machine appliance.

Referring still to FIG. 6, method 400 may further include a step 420 of estimating an energy requirement for drying the load of articles. The estimated energy requirement of step 420 may be based on the determined remaining moisture content of the load of articles from step 410. For example, the estimated energy requirement to dry the load of articles may be based on the determined remaining moisture content of the load of articles and a moisture removal rate. For example, the moisture removal rate may be expressed in mass or weight of moisture that is removed per unit of energy that is supplied, such as pounds (lbs.) of moisture per kWh of energy. In some embodiments, the moisture removal rate may be empirically determined and may be stored in a memory of the controller of the dryer appliance.

In various embodiments, the estimated energy requirement may be used to determine an estimated total cycle time, an estimated remaining cycle time (when compared with actual energy output, as described below), and/or a cycle termination point (also when compared with the actual energy output). For example, in some embodiments, method 400 may include, prior to activating the heating system, determining an estimated total cycle time for the dry cycle and providing a user notification of the estimated total cycle time. Such estimated total cycle time may be based on one or more of the estimated energy requirement to dry the load of articles, the determined remaining moisture content of the load of articles, and/or the moisture removal rate. For example, the estimated total cycle time may be based on, e.g., proportional to, the estimated energy requirement to dry the load of articles. The user notification may be provided on a user interface of the dryer appliance or on a remote user interface, such as on a smartphone, tablet, personal computer, smart home system or other similar device that is not physically connected to the dryer appliance. For example, the user notification may be provided in an application or "app" running on a smart phone that communicates wirelessly with the dryer appliance. The user notification may include one or more of a visual notification, e.g., illuminating an indicator light or providing a text notification, and/or an audible notification, such as a chime or alert tone, etc.

As illustrated in FIG. 6, in some embodiments, method 400 may also include a step 430 of activating a heating system of the dryer appliance during a dry cycle of the dryer appliance. For example, the heating system may include one or more heating elements which may be operated at varying percentages as described above in reference to FIG. 5.

In some embodiments, method 400 may further include a step 440 of tracking an energy output of the heating system during the dry cycle. For example, the energy output 800 illustrated in FIG. 5 and described above may be tracked during the dry cycle.

Still referring to FIG. 6, in some embodiments, the exemplary method 400 may also include a step 450 of comparing the tracked energy output to the estimated energy requirement. Thus, the energy output provided during the dry cycle may represent a status of the dry cycle, e.g., when the tracked energy output is about fifty percent of the estimated energy requirement, it may be inferred that the dry cycle is about halfway done, e.g., that about one half (fifty percent) of the cycle time has elapsed.

As illustrated in FIG. 6, in some embodiments, method 400 may further include a step 460 providing a user notification when the tracked energy output is greater than a predetermined threshold percentage of the estimated energy requirement. As described above, the user notification may include one or more local and/or remote notifications and visual and/or audible notifications. The predetermined threshold percentage may correspond to an amount of time remaining to complete the dry cycle, e.g., a target time, which may be a predetermined amount of time remaining in the dry cycle. The predetermined amount of time may be between about five minutes and about twenty minutes, such as between about ten minutes and about fifteen minutes, such as about fifteen minutes or about ten minutes. The predetermined threshold percentage may be, e.g., about ninety percent. Further, the predetermined threshold percentage may be adjusted after one or more cycles to more accurately reflect the target remaining time, e.g., the predetermined amount of time, such as about ten minutes or about fifteen minutes, etc., as mentioned. The predetermined threshold percentage may be adjusted, e.g., in response to a calculated error rate, described below.

In some embodiments, exemplary methods of operating a dryer appliance may also include error correction steps. For example, the method 400 may, in some embodiments, further include comparing a total energy output of the heating system over the entire dry cycle to the estimated energy requirement and determining an error from the comparison of the energy output of the heating system to the estimated energy requirement. For example, where the actual total energy output varied from the estimated energy requirement, this variation may indicate an error or inaccuracy in the estimation. The error may be expressed as a ratio or percentage, such as the actual, tracked, total energy output divided by the estimated energy requirement, and such division operation is an example embodiment of comparing the total energy output of the heating system over the entire dry cycle to the estimated energy requirement. After determining the error, the threshold percentage of the estimated energy requirement at which the user notification is provided may be adjusted in response to the determined error, such as proportionally to the magnitude of the determined error. Thus, for example, the threshold percentage of the estimated energy requirement at which the user notification is provided may be adjusted to more closely reflect the target time remaining, as discussed above. In some embodiments, the adjustment may be based on an adjustment factor, for example, the method 400 may include calculating an adjustment factor based on the determined error and applying the adjustment factor to the predetermined threshold percentage. By applying the adjustment factor to the predetermined threshold percentage, an adjusted predetermined threshold percentage may be derived. Thus, in a subsequent, e.g., second, dry cycle after the first dry cycle, the user notification may be provided when a tracked energy output during the second dry cycle is greater than the adjusted predetermined threshold percentage of an estimated energy requirement for the second dry cycle. Further, if the error value is above a service threshold, a diagnostic code may be triggered or generated in response to the determined error.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a dryer appliance, the dryer appliance comprising a cabinet, a drum rotatably mounted within the cabinet, the drum defining a chamber for the receipt of articles for drying, and a heating system fluidly coupled to the drum whereby heated air flows from the heating system to the chamber of the drum for drying of articles within the chamber, the method comprising:

determining a remaining moisture content of a load of articles to be dried in the dryer appliance;

estimating an energy requirement for drying the load of articles based on the determined remaining moisture content of the load of articles;

activating the heating system of the dryer appliance during a first dry cycle of the dryer appliance;

tracking an energy output of the heating system during the first dry cycle;

comparing the tracked energy output to the estimated energy requirement;

providing a user notification when the tracked energy output is greater than a predetermined threshold percentage of the estimated energy requirement;

comparing, after the dry cycle, a total energy output of the heating system to the estimated energy requirement and determining an error from the comparison of the energy output of the heating system to the estimated energy requirement;

calculating an adjustment factor based on the determined error;

applying the adjustment factor to the predetermined threshold percentage, thereby deriving an adjusted predetermined threshold percentage; and providing a user notification in a second dry cycle after the first dry cycle when a tracked energy output during the second dry cycle is greater than the adjusted predetermined threshold percentage of an estimated energy requirement for the second dry cycle.

2. The method of claim 1, wherein estimating the energy requirement is also based on a moisture removal rate.

3. The method of claim 1, wherein the step of determining the remaining moisture content comprises receiving remaining moisture content information from a washer appliance.

4. The method of claim 1, further comprising generating a diagnostic code when the determined error is greater than a threshold.

5. The method of claim 1, wherein the predetermined threshold percentage corresponds approximately to a predetermined amount of time remaining in the dry cycle.

6. The method of claim 1, wherein tracking the energy output comprises tracking a power level of the heating system and a duty cycle of the heating system during the dry cycle.

7. The method of claim 1, further comprising, prior to activating the heating system, determining an estimated total cycle time for the dry cycle and providing a user notification of the estimated total cycle time.

8. A dryer appliance comprising:

a cabinet;

a drum rotatably mounted within the cabinet, the drum defining a chamber for the receipt of articles for drying;

a heating system fluidly coupled to the drum whereby heated air flows from the heating system to the chamber of the drum for drying of articles within the chamber; and a controller, the controller configured for:

determining a remaining moisture content of a load of articles to be dried in the dryer appliance;

estimating an energy requirement for drying the load of articles based on the determined remaining moisture content of the load of articles;

activating the heating system of the dryer appliance during a first dry cycle of the dryer appliance;

tracking an energy output of the heating system during the first dry cycle;

comparing the tracked energy output to the estimated energy requirement;

providing a user notification when the tracked energy output is greater than a predetermined threshold percentage of the estimated energy requirement;

comparing, after the dry cycle, a total energy output of the heating system to the estimated energy requirement and determining an error from the comparison of the energy output of the heating system to the estimated energy requirement;

calculating an adjustment factor based on the determined error;

applying the adjustment factor to the predetermined threshold percentage, thereby deriving an adjusted predetermined threshold percentage; and providing a user notification in a second dry cycle after the first dry cycle when a tracked energy output during the second dry cycle is greater than the adjusted predetermined threshold percentage of an estimated energy requirement for the second dry cycle.

9. The dryer appliance of claim 8, wherein estimating the energy requirement is also based on a moisture removal rate.

10. The dryer appliance of claim 8, wherein the controller is in communication with a washer appliance, and wherein determining the remaining moisture content comprises receiving the remaining moisture content information from the washer appliance.

11. The dryer appliance of claim 8, wherein the controller is further configured for generating a diagnostic code when the determined error is greater than a threshold.

12. The dryer appliance of claim 8, wherein the predetermined threshold percentage corresponds approximately to a predetermined amount of time remaining in the dry cycle.

13. The dryer appliance of claim 8, wherein tracking the energy output comprises tracking a power level of the heating system and a duty cycle of the heating system during the dry cycle.

14. The dryer appliance of claim 8, wherein the controller is further configured for, prior to activating the heating system, determining an estimated total cycle time for the dry cycle and providing a user notification of the estimated total cycle time.

* * * * *